US006622822B1

(12) United States Patent
Langhoff et al.

(10) Patent No.: US 6,622,822 B1
(45) Date of Patent: Sep. 23, 2003

(54) BUNK LADDER

(75) Inventors: Richard V. Langhoff, Greensboro, NC (US); David M. Glorio, Oak Ridge, NC (US)

(73) Assignee: Volvo Trucks North America, Inc., Greensboro, NC (US)

( * ) Notice: Subject to any disclaimer, the term of this patent is extended or adjusted under 35 U.S.C. 154(b) by 0 days.

(21) Appl. No.: 10/209,998

(22) Filed: Aug. 1, 2002

(51) Int. Cl.[7] ..... E04G 3/00

(52) U.S. Cl. ..... 182/90; 182/93; 182/96; 182/127; 5/2.1

(58) Field of Search ..... 182/90, 92, 93, 182/107, 96, 160, 163, 127; 5/2 R, 9 R

(56) References Cited

U.S. PATENT DOCUMENTS

| | | | | | |
|---|---|---|---|---|---|
| 482,391 | A | | 9/1892 | Stanley | |
| 691,872 | A | * | 1/1902 | Rehkopf | 182/90 X |
| 1,083,939 | A | | 1/1914 | Paterson | |
| 1,887,301 | A | | 11/1932 | Gordon | |
| 2,544,980 | A | | 3/1951 | Brown | |
| 2,957,541 | A | | 10/1960 | Everest et al. | |
| 3,033,309 | A | * | 5/1962 | Fugere | 182/90 X |
| 3,498,410 | A | | 3/1970 | Storch | |
| 3,512,608 | A | | 5/1970 | Huntley | |
| 3,980,157 | A | | 9/1976 | Wrigley | |
| 3,997,027 | A | * | 12/1976 | Patterson et al. | 182/195 |
| 4,067,588 | A | | 1/1978 | Morge et al. | |
| 4,161,997 | A | * | 7/1979 | Norman | 182/93 |
| 4,231,583 | A | * | 11/1980 | Learn | 280/166 |
| 4,312,086 | A | | 1/1982 | Bianco | |
| 4,431,082 | A | | 2/1984 | Bott | |
| 4,463,829 | A | | 8/1984 | Grin | |
| 4,483,027 | A | * | 11/1984 | Cowell et al. | 5/136 |
| 4,556,125 | A | | 12/1985 | Johnson | |
| 4,719,989 | A | | 1/1988 | Ritten | |
| 4,907,673 | A | | 3/1990 | Ginter et al. | |
| 5,024,292 | A | * | 6/1991 | Gilbreath et al. | 182/90 |
| 5,033,582 | A | | 7/1991 | Hoben | |
| 5,046,582 | A | * | 9/1991 | Albrecht | 182/127 |
| 5,123,372 | A | | 6/1992 | Kobayashi et al. | |
| 5,174,411 | A | * | 12/1992 | Oliver et al. | 182/77 |
| 5,339,920 | A | | 8/1994 | Eriksson | |
| 5,498,012 | A | * | 3/1996 | McDaniel et al. | 280/166 |
| 5,526,898 | A | * | 6/1996 | Clark | 182/200 |
| 5,632,591 | A | | 5/1997 | Henriquez | |
| 5,687,813 | A | | 11/1997 | Bensch | |
| 5,806,626 | A | * | 9/1998 | Jenkins, Jr. | 182/100 |
| 5,927,433 | A | * | 7/1999 | Jaramillo, Sr. | 182/91 |
| 6,003,633 | A | * | 12/1999 | Rolson | 182/127 |
| 6,220,389 | B1 | | 4/2001 | Krause | |
| 6,264,222 | B1 | | 7/2001 | Johnston et al. | |
| 6,282,872 | B1 | * | 9/2001 | Schulte | 54/49 |
| 6,422,342 | B1 | * | 7/2002 | Armstrong et al. | 182/127 |
| 6,425,572 | B1 | * | 7/2002 | Lehr | 256/1 |
| 6,435,534 | B1 | * | 8/2002 | Stone | 280/163 |

* cited by examiner

*Primary Examiner*—Bruce A. Lev
(74) *Attorney, Agent, or Firm*—Watts Hoffman Co., L.P.A.

(57) ABSTRACT

An adjustable ladder with self-storing features and suitable for installation in the sleeping berth of an over-the-highway tractor. The ladder includes an upper and lower member. The upper member includes first and second side rails and at least one step rung rigidly disposed between the side rails. The first side rail includes a mounting end, an open end, and a center portion. One end of the first and second side rails are rotateably mounted to a mating surface. The lower member includes a first end, a second end, and a center portion extending between the first and second ends. The lower member first end is slideably engaged within the upper member open end to define a ladder length. The length is adjustable over a range by sliding the lower member with respect to the upper member. The range may be from an application length to a stored length.

20 Claims, 6 Drawing Sheets

BUNK LADDER

FIELD OF THE INVENTION

The present invention is directed to a ladder, and more particularly, is directed to a bunk ladder for installation in an over-the-highway tractor.

BACKGROUND OF THE INVENTION

A ladder is a well known apparatus for providing an access path to an elevated area. Conventional ladder designs include two parallel elongated rails connected by a series of equally spaced rungs. Fixed ladder designs of this type are impractical in confined areas that prohibit transporting and maneuvering of the ladder into and out of useable positions.

One example of a confined area requiring a ladder is the sleeping berth of an over-the-highway tractor. Over-the-highway tractors often contain a sleeping berth in which a driver may rest during periods of non-driving. When an operator is required to travel for an extended period of days, often a second operator or a companion passenger, accompanies the driver because of safety concerns. To accommodate two persons, some over-the-highway tractors contain a sleeping berth with twin bunk beds. In these tractor designs, a ladder is required for ingress and egress to the upper bunk.

A conventional sleeping berth containing bunk beds presents several challenges to the design of a suitable ladder. The relatively tight configuration of the sleeping berth allows little room for maneuvering a ladder in and out of a useful position. Further, a suitable ladder must be securely fastened to the bunk when in use for operator safety. However, when not in use, any ladder installed in the berth must be unobtrusive to the driver and passenger of the tractor.

Typical bunk beds installed in tractors are asymmetric in size. The top bunk of many tractor designs is hinged in several places against the back berth wall. Consequently, the upper bunk can be rotated up to be stowed flush with the back wall when not is use. Therefore, any ladder design that mounts on the top bunk must allow for storage of the upper bunk. In addition, the width of the top bunk is often less than the width of the bottom bunk, further challenging ladder design.

A need exists in the market for a ladder design that is easy to operate, is self storing in an unobtrusive position when not in use, and accommodates asymmetric application environments.

SUMMARY OF THE INVENTION

The adjustable grab handle of the present invention provides a ladder apparatus for installation in a variety of application settings. The ladder includes a telescoping feature and adjusts to a range of application lengths, while allowing storage in a relatively small area when not in use. The invention is beneficial to original equipment manufacturers, such as over-the-highway tractor manufacturers.

In a first embodiment, a ladder apparatus for installation in an environment to aid access to an elevated area within the environment is disclosed. The apparatus includes an upper member and a lower member.

The upper member includes an elongated first side rail, an elongated second side rail and at least one step rung. The elongated first side rail includes a mounting end, an open end, and a center portion extending between the mounting end and the open end. At least the part of the center portion disposed adjacent the open end is hollow. The mounting end has structure for rotateably mounting the first side rail to a first mating surface. The open end defines an aperture.

The elongated second side rail includes a first end, a second end, and a center portion extending between the first end and the second end. The first end has structure for rotateably mounting the second rail to a second mating surface. The at least one step rung is rigidly disposed between the first and second side rails.

The lower member includes a first end, a second end, and a center portion extending between the first end and second end. The lower member first end is slideably engaged within the upper member open end to define a ladder length. The second end has structure for removably mounting the lower member to a third mating surface when the ladder is in use and to a fourth mating surface when the ladder is in storage.

A length of the ladder is adjustable over a range by sliding the lower member with respect to the upper member.

The lower member second end may include a latch mechanism. The latch is adapted to alternatively be removably fixed to the third mating surface or to the fourth mating surface.

The second side rail may include a portion essentially parallel to the at least one step rung such that the portion forms a second step rung. The second side rail second end may terminate at the first side rail. The upper member and the lower member may be constructed of extruded plastic.

The apparatus may include a spring disposed within the elongated first side rail. The spring is connected between the first side rail mounting end and the lower member first end. The spring will extend when the apparatus is in use and recoil when the apparatus is in storage.

In a second embodiment, in an over-the-highway tractor having a sleeping berth containing a bunk system, the system including a back wall, an upper bunk frame, a lower bunk frame, and a ladder for aiding operator access to the upper bunk, an improved ladder is disclosed.

The ladder includes an upper member and a lower member. The upper member includes an elongated first side rail, an elongated second side rail and at least one step rung. The elongated first side rail includes a mounting end, an open end, and a center portion. At least the part of the center portion disposed adjacent the open end is hollow. The mounting end has structure for rotateably mounting the first side rail to a first mating surface defined by the upper bunk frame. The open end defines an aperture.

The elongated second side rail includes a first end, a second end, and a center portion. The first end has structure for rotateably mounting the second rail to a second mating surface defined by the upper bunk frame. The at least one step rung is rigidly disposed between the first and second side rails.

The lower member includes a first end, a second end, and a center portion. The lower member first end is slideably engaged within the upper member open end to define a ladder length. The second end has structure for removably mounting the lower member to a third mating surface when the ladder is in use and to a fourth mating surface when the ladder is in storage.

The third mating surface is defined by the lower bunk frame and the fourth mating surface is defined by the upper bunk frame. A length of the ladder is adjustable over a range by sliding the lower member with respect to the upper member. The range is at least from a storage length to an application length.

The application length may be essentially equal to the distance from an outermost point of the upper bunk frame to an outermost point of the lower bunk frame. The storage length may not exceed a length of the upper bunk frame. The ladder nests when mounted in a stored position adjacent an underside of the upper bunk frame.

The apparatus may include a spring disposed within the elongated first side rail. The spring is connected between the first side rail mounting end and the lower member first end. The spring will extend when the apparatus is in an application configuration and recoil when the apparatus is collapsed to a storage configuration.

Further advantages and a fuller understanding of the invention will be had from the accompanying drawings and the detailed description of the invention.

DETAILED DESCRIPTION OF THE PREFERRED EMBODIMENT

Figure 1:
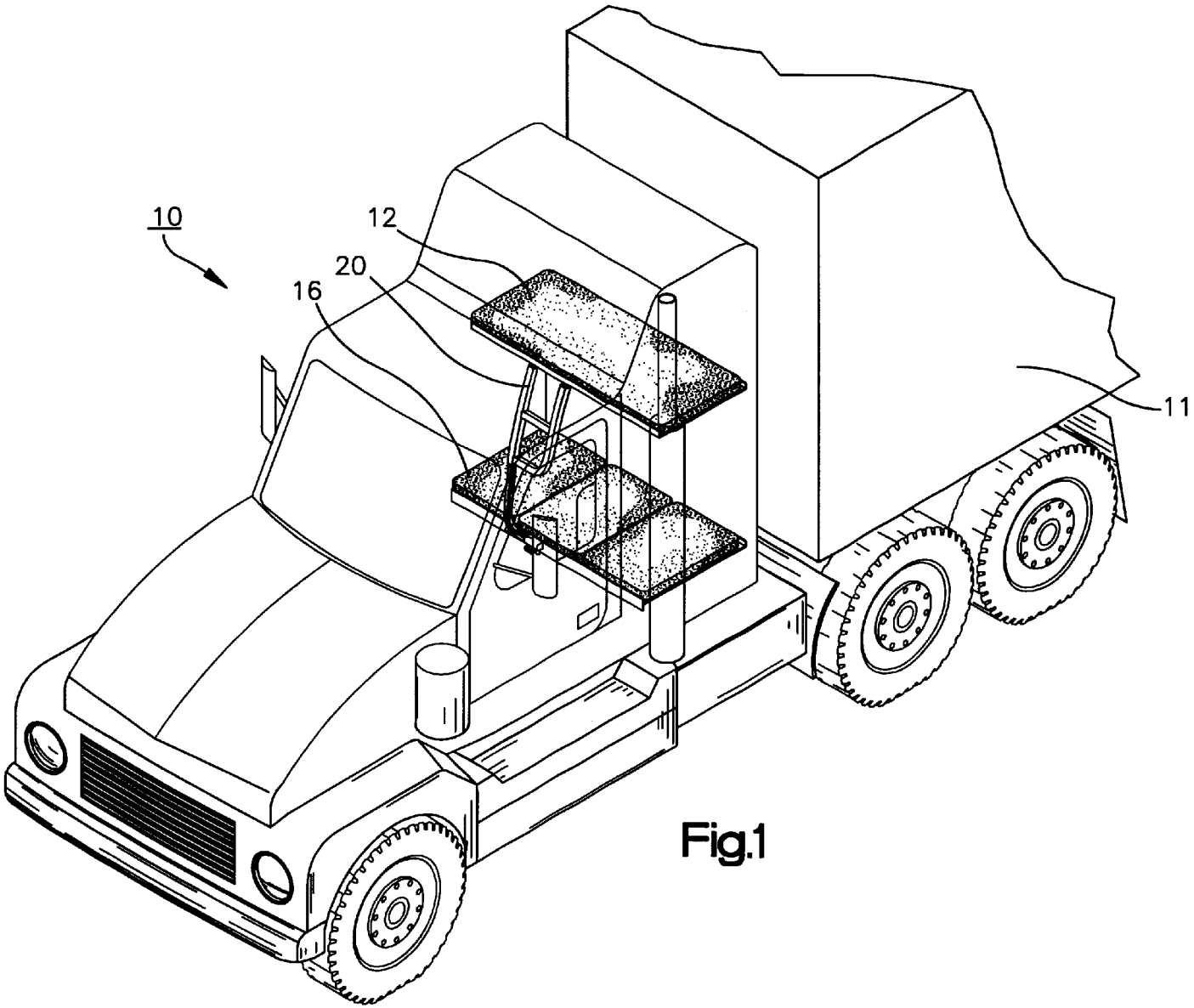
FIG. 1 is a perspective view of an over-the-highway tractor, partially in section, showing a sleeping berth having a bunk ladder constructed in accordance with the preferred embodiment of the present invention.

Referring now to the drawings, FIG. 1 is a perspective view of an over-the-highway tractor 10 designed to pull an elongated trailer 11. As illustrated, the tractor 10 contains a sleeping berth for use by the driver during periods of non-driving, or by a passenger. The sleeping berth includes a upper bunk assembly 12, a lower bunk assembly 16 and an improved ladder 20. The ladder 20 is used to provide access to the upper bunk 12.

A ladder 20 constructed in accordance with the present invention is suitable for installation in multiple environments to aid access to an elevated area within the environment. For exemplary purposes, the invention will be described in the environment of a tractor sleeping berth.

Figure 2:
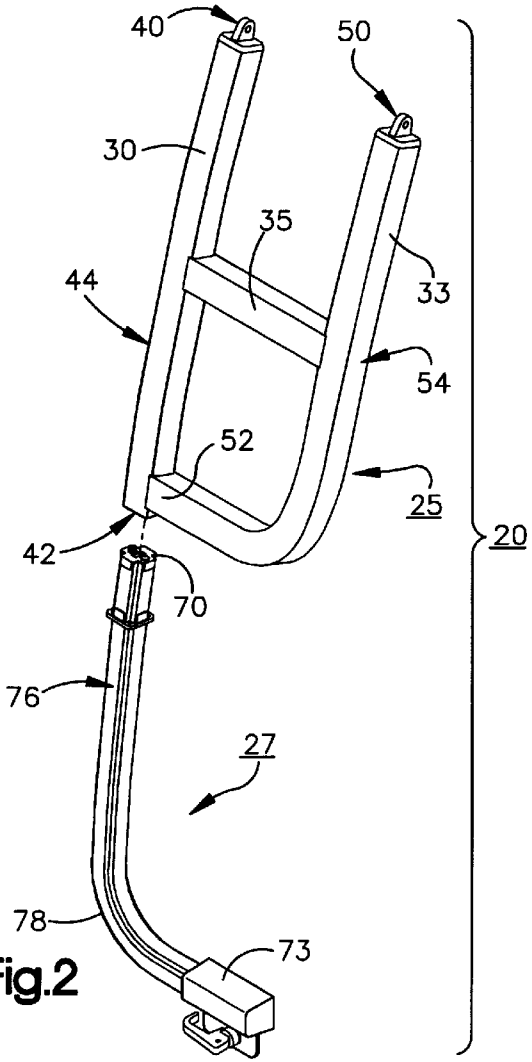
FIG. 2 is a perspective view of the bunk ladder of FIG. 1, shown in a partially assembled form.
Figure 5:
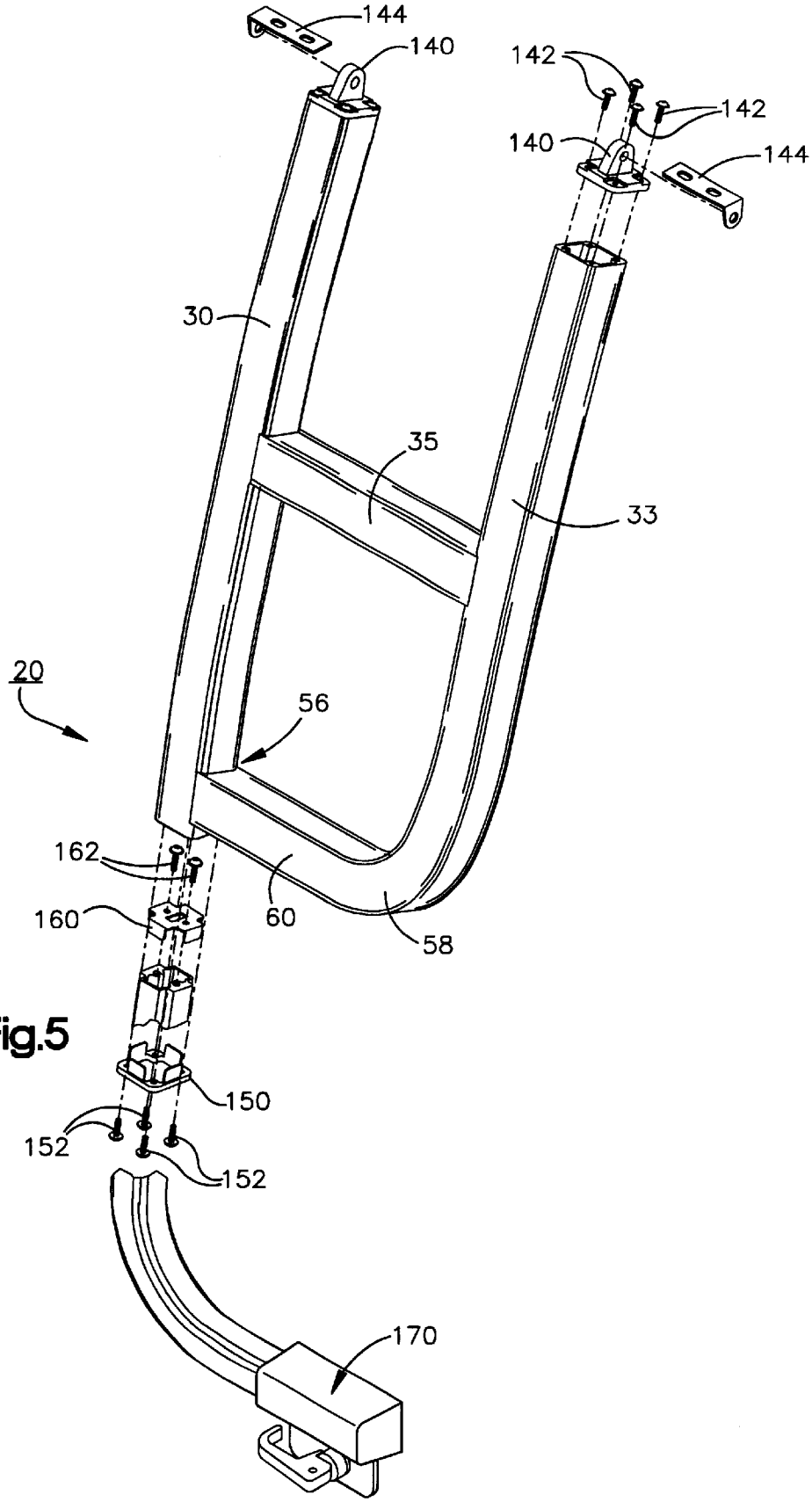
FIG. 5 is an exploded perspective view of the bunk ladder apparatus of FIG. 1.

Referring now to FIG. 2, a perspective view of the bunk ladder of the present invention is illustrated in a partially assembled form. An exploded perspective view of the bunk ladder is illustrated in FIG. 5.

The ladder 20 includes an upper member 25 and a lower member 27. When assembly is complete, a portion of the lower member 27 is slideably inserted within a portion of the lower member 25. The ladder 20 is advantageously adjustable to a range of application lengths and storage lengths. In the application environment of a tractor sleeping berth, the ladder 20 is easy to operate, is self storing in an unobtrusive position when not in use, and accommodates asymmetric bunk bed sizes.

In the preferred embodiment, the upper member 25 and lower member 27 are constructed of extruded plastic. However, it should be understood by others with ordinary skill in the art that other materials of sufficient strength, or combination of materials, may be used to construct the ladder members in the practice of this invention.

Figure 3:
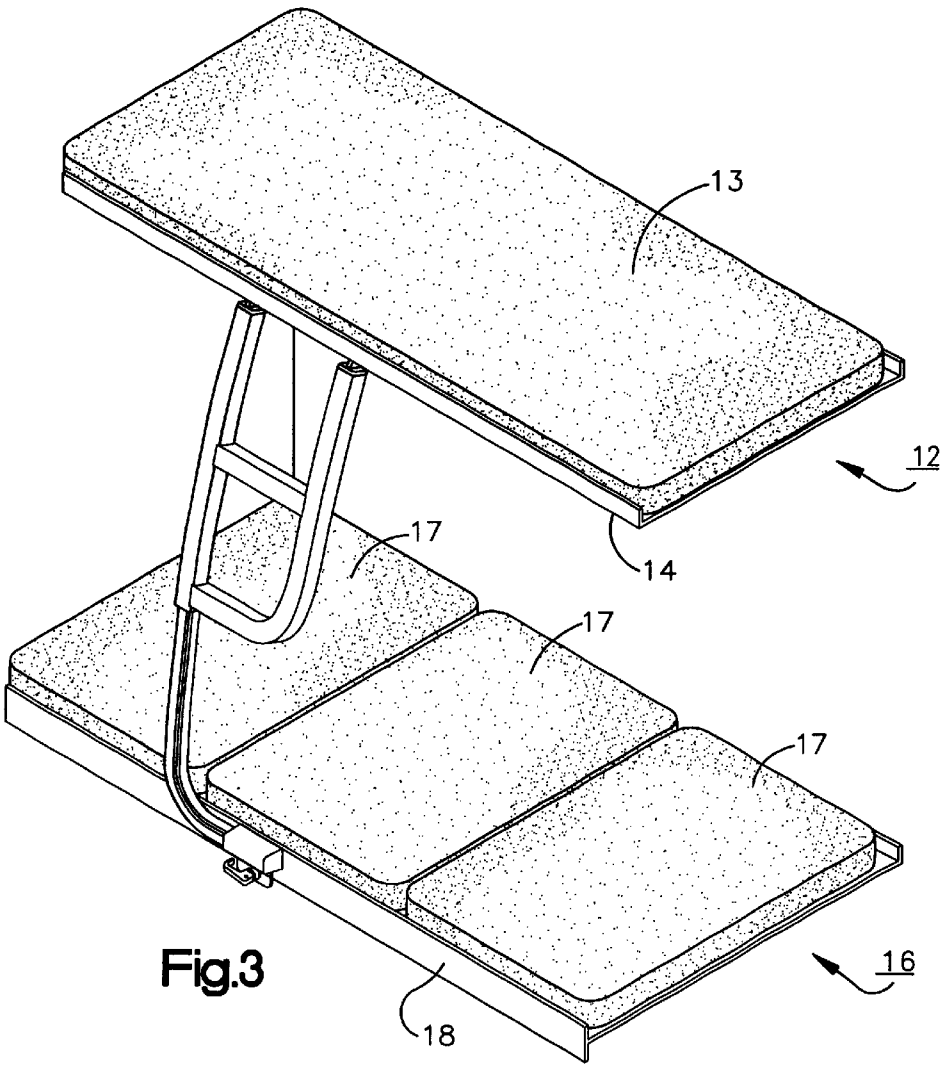
FIG. 3 is a perspective view of the bunk ladder of FIG. 1, shown in an installed position on a bunk bed.

FIG. 3 is a perspective view of the bunk ladder of the present invention shown in an installed position on a bunk bed assembly. The upper bunk bed 12 includes a mattress 13 and an upper bunk frame 14. Similarly, the lower bunk bed 16 includes a mattress 17 and a lower bunk frame 18.

Referring again to FIGS. 2 and 5, the upper member 25 includes an elongated first side rail 30, an elongated second side rail 33, and at least one step rung 35. As illustrated, the step rung 35 is rigidly disposed between the first side rail 30 and second side rail 33. It should be understood by others with ordinary skill in the art that a plurality of step rungs may be used in the practice of this invention.

The elongated first side rail 30 includes mounting end 40, an open end 42, and a center portion 44. The mounting end 40 has structure for rotateably mounting the first side rail 30 to a first mating surface. As illustrated in FIGS. 3 and 5, the first mating surface is the underside frame 14 of the upper bunk assembly 12.

The mounting end 40 includes an upper end cap 140. As illustrated in FIG. 5, the upper end cap 140 is rigidly fixed to the mounting end 40 by conventional six point socket screws 142. Any suitable hardware may be used in the practice of the invention.

The upper end cap 140 contains a mounting hole for mounting the ladder to a ladder mounting bracket 144. The mounting bracket 144 includes a planar portion that is mounted flush to a bunk frame by conventional means.

The center portion 44 extends between the mounting end 40 and the open end 42. At least the part of the center portion 44 disposed adjacent the open end 42 is hollow. In the preferred embodiment, the entire center portion is hollow. The hollow center portion 44 terminates at an aperture defined by the open end 42.

The elongated second side rail 33 includes a first end portion 50, a second end portion 52, and a center portion 54. The first end 50 has structure for rotateably mounting the second side rail 33 to a second mating surface. As illustrated in FIGS. 3 and 5, the second mating surface is the underside frame 14 of the upper bunk assembly 12.

As illustrated, the second end portion includes an upper end cap 140 and mounting hardware 144. Similar to the first side rail 30, the upper end cap 140 is mounted to a mounting bracket 144 which is fixed to a bunk frame 14.

Figure 6:
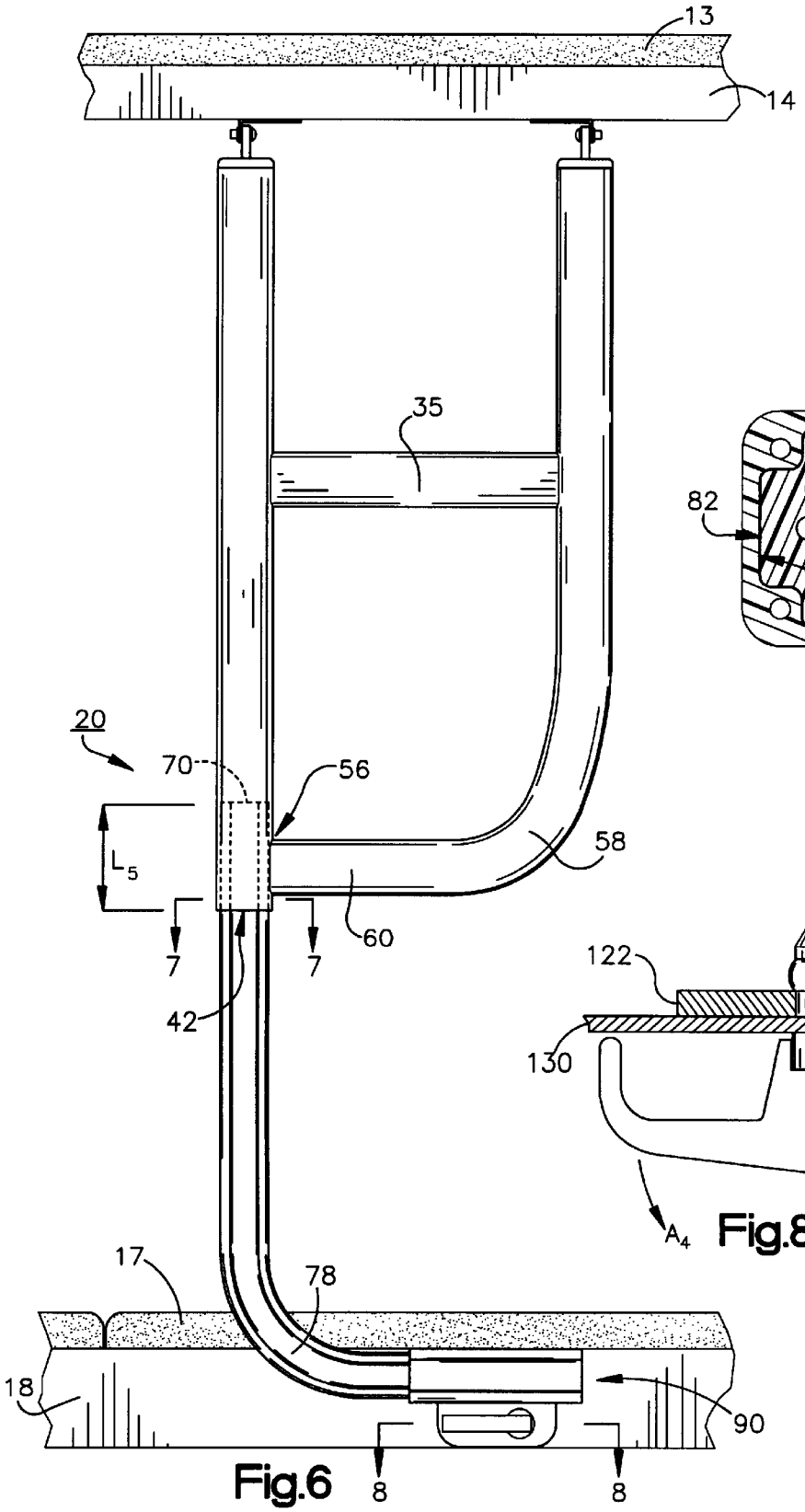
FIG. 6 is a front view of the bunk ladder apparatus of FIG. 1, shown in an installed position.

The center portion 54 extends between the first end 50 and the second end 52. As illustrated in FIG. 6, the center portion 54 of the second side rail 33 is slightly arcuate with respect, and toward, the center portion 44 of the first side rail 30.

As shown in FIGS. 5 and 6, the second side rail 33 connects directly to the first side rail 30 at a location 56 near the first side rail open end 42. In the preferred embodiment, the second side rail 33 second end 52 terminates at the first side rail 30. The connection is a result of an arcuate portion 58 of the second side rail 33 center portion 54.

The arcuate portion also advantageously creates a second step rung. Again referring to FIG. 6, the second side rail 33 includes a portion 60 essentially parallel to the step rung 35 that connects the first 30 and second 33 elongated members. The portion provides a second step rung 60 for use in accessing the upper bunk 12.

Referring again to FIGS. 2 and 6, the upper member 25 is fixedly joined to the lower member 27 in an assembled ladder 20. The lower member 27 includes a first end 70, a second end 73, and a center portion 76. As illustrated, the center portion 76 extends between the first end 70 and second end 73. In the preferred embodiment, the lower member 27 center portion 76 includes an arcuate portion 78. A protective tread piece may be included 170.

Referring now to FIG. 5, the upper member 25 open end 42 includes an outer bearing cap 150. The cap 150 is mounted to the open end by use of four hardware screws 152. The lower member 27 first end 70 includes an inner bearing cap 160. The inner cap 160 is mounted to the first end by use of two hardware screws 162. As illustrated, the outer 150 and inner 160 bearing caps are injected molded.

The exploded view shows the caps 150, 160 in order of assembly. When the ladder is assembled, it is preferred that the inner cap 160 and screws 162 are installed first. The outer cap 150 is then installed, without hardware, prior to inserting the lower member 27 into the aperture 42. Lastly, the outer cap is secured by installing conventional hardware 152. In the preferred embodiment, the lower member may not be manually removed from the upper member.

FIG. 6 is a front view of a ladder of the present invention, with the ladder 20 shown in an installed position. As illustrated, the lower member 27 first end 70 is slideably engaged within the upper member 25 open end 42. As seen in FIGS. 4*b* and 4*c*, the engaging of the first and second members define a ladder length $L_3$, $L_4$. The length of the ladder is adjustable over a range by sliding the lower member 27 with respect to the upper member 25.

The length of the ladder is a function of the overlap between the upper member 25 and the lower member 27. As best shown in FIG. 6, the lower member 27 first end 70 is slideably engaged within upper member 25 open end 42. As illustrated, the engagement creates an overlap of the two members defining a length $L_5$. The overlap length $L_5$ increases as the ladder length decreases and conversely, decreases as the ladder length increases. This advantageous feature allows for installation in a range of multiple application lengths. As illustrated in FIGS. 4*b* and 4*c*, the range is at least from a storage length $L_4$ to an application length $L_3$.

Figure 4A:
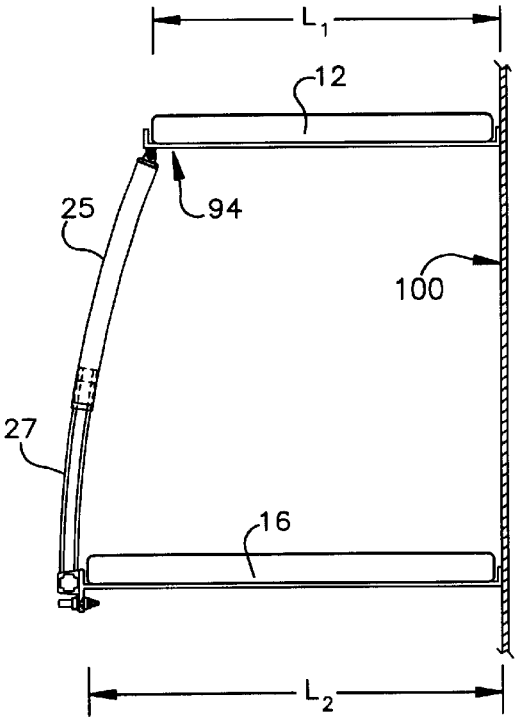
FIGS. 4*a*–4*d* are side views of the bunk ladder of FIG. 1, showing a series of sequential views from an installed position to a stowed position.
Figure 4B:
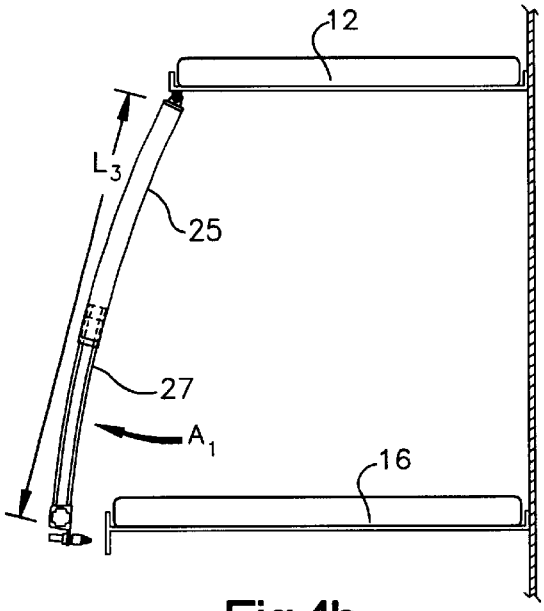
Figure 4C:
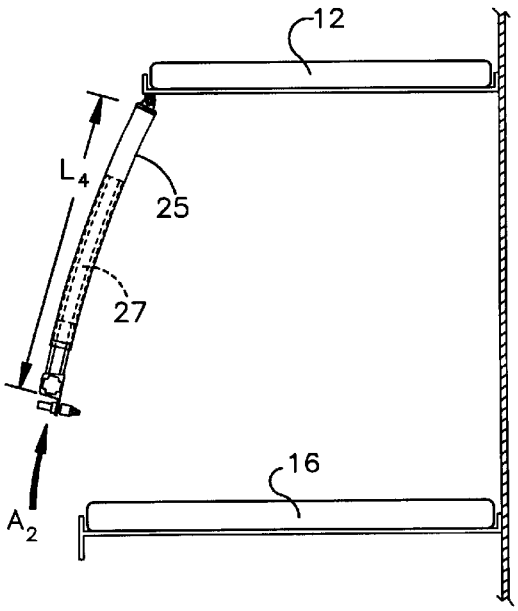
Figure 4D:
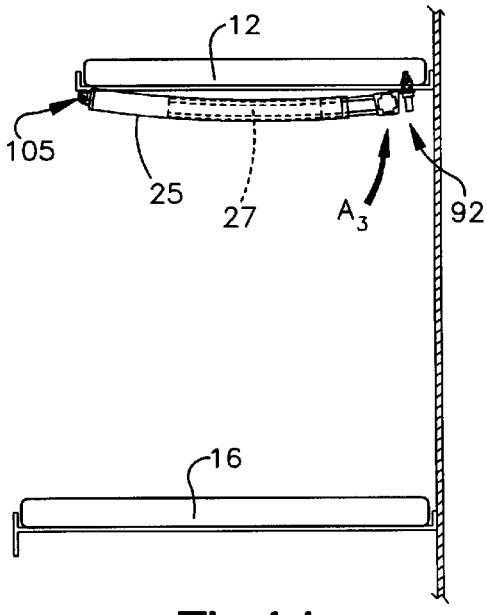

As shown in FIGS. 4*a* and 4*d*, in the preferred embodiment the range is suitable for use with a bunk bed. The application length $L_3$ is essentially equal to the distance from the outermost point of the upper bunk frame to the outermost point of the lower bunk frame. The storage length $L_4$ preferably does not exceed a length of the upper bunk frame. In an alternative embodiment, at least a part of the ladder may rest in a recess defined by the underside of the upper bunk frame.

Figure 7:
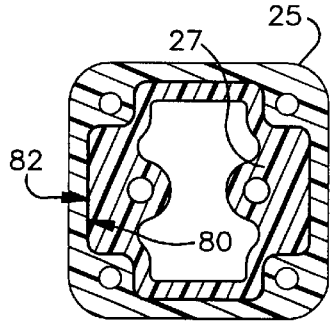
FIG. 7 is a sectional view of a part of the bunk ladder of FIG. 1, as seen from a plane indicated by the line 7—7 in FIG. 6.

The preferred embodiment of the ladder includes yet another advantageous application feature. The aperture 42 and hollow portion of the center portion 44 and the lower member first end 70 are adapted to essentially prohibit rotational movement of the lower member 27 with respect to the upper member 25. Referring now to FIG. 7, a sectional view of a part of the bunk ladder is illustrated, as seen from a plane indicated by the line 7—7 in FIG. 6. The upper member 25 forms a hollow channel have an inner surface 80. The inner surface 80 is cross-shaped and engages a cooperatively shaped outer surface 82 of the lower member 27. The shape of the inner 80 and outer 82 surfaces prohibit rotational movement of the lower member 27 with respect to the upper member 25, and consequently, increase operator safety. It should be understood by others with ordinary skill in the art that other suitable cross-sectional shapes may be used in the practice of the present invention.

As discussed, the lower member 27 includes a second end 73. The second end 73 provides the user with flexibility in fixing the ladder in either a stored position or an application position. Specifically, the second end 73 has structure for removably mounting the lower member 27 to a third mating surface when the ladder is in use and to a fourth mating surface when the ladder is in storage.

In the exemplary application illustrated in FIG. 6, the third mating surface 90 is defined by the lower bunk frame 18. In the exemplary application illustrated in FIG. 4*d*, the fourth mating surface 92 is defined by the upper bunk frame 14.

The preferred embodiment of the grab handle includes yet another advantageous application feature. A ladder of the present invention can easily adjust from an application position to a stored position. Referring now to FIGS. 4*a*–4*b*, a series of sequential views are illustrated, showing the steps of a ladder of the present invention being manually manipulated from an installed position to a stowed position.

In FIG. 4*a*, the ladder is illustrated in an installed position. The first and second side rails are mounted to the bottom surface 94 of the upper bunk frame 14. The second end 73 of the lower member is mounted to the side surface 90 of the lower bunk frame 18. As illustrated, the ladder is secure and provides a safe and stable travel path to the upper bunk.

In FIG. 4*b*, the ladder is illustrated is a transitional position. The lower end 73 has been dismounted from the lower bunk frame. The ladder has been rotated away from the bunk in the direction of the arrow $A_1$. In the preferred embodiment, the rotational movement allows the ladder to be easily manipulated in an unencumbered space.

As illustrated in FIG. 4*d*, the upper bunk extends from a berth wall 100 a length $L_1$. In comparison, the lower bunk extends a relatively longer distance $L_2$. In some sleeping berth bunk designs, the bunk widths are asymmetric to allow for the upper bunk to be rotated against the berth wall 100 when not in use. The arcuate shape of the ladder 20 allows for this and other asymmetric bunk designs.

In FIG. 4*c*, the lower member 27 has been slid further inside the upper member 25 in the direction of the arrow A2. The length of the ladder is illustrated as a storage length $L_4$. As seen in FIG. 4*d*, the storage length $L_4$ does not exceed the width of the upper bunk.

In FIG. 4*d*, the ladder has been rotated about a mounting hardware 105 disposed near the outermost edge of the upper bunk frame 14. As can be seen, the ladder has been rotated in the direction of the arrow A3. The lower end 73 is removably fixed to the upper bunk frame near the berth back wall 100. In this position, the ladder is securely stored and does not prohibit a person from easy enter to the bottom bunk.

In a preferred embodiment, the structure of the lower member second end includes a latch mechanism. The preferred latch mechanism is easily manually operated and adapted to alternatively be removably fixed to a mating surface for use or to a mating surface for storage.

Figure 8:
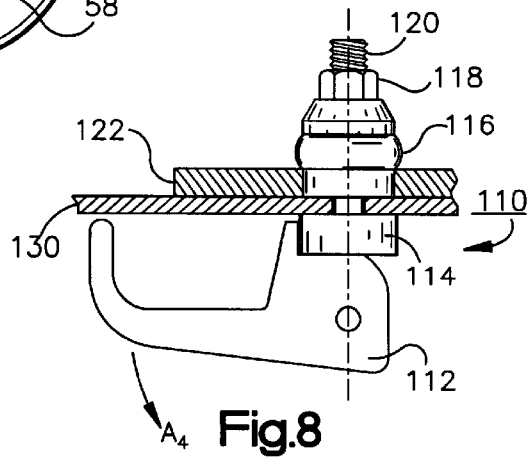
FIG. 8 is a side view, partially in section, of a part of the bunk ladder of FIG. 1, as seen from a plane indicated by the line 8—8 in FIG. 6.

Referring now to FIG. 8, a side view, illustrated partially in section, of a latch mechanism is shown. The figure is illustrated as seen from a plane indicated by the line 8—8 in FIG. 6. The latch is shown in an engaged position.

As illustrated, the latch assembly includes a handle 112, a washer 114, a bushing 116, a nut 118, a shaft 120 and a latch frame 122. All hardware is conventional. The latch frame 122 is mounted against the distal side of the bunk frame 130, with respect to the handle 112. The washer 114 mates flush with the proximal side of the bunk frame. An operator rotates the handle 112 in the direction of the arrow $A_4$ to disengage the latch.

A suitable swell action latch assembly is commercially available as part number 19-14-10 from Southco®, doing business at 210 North Brinton Lake Road, Concordville, Pa. 19331-0116, with a phone number of (610) 459-4000.

Figure 9:
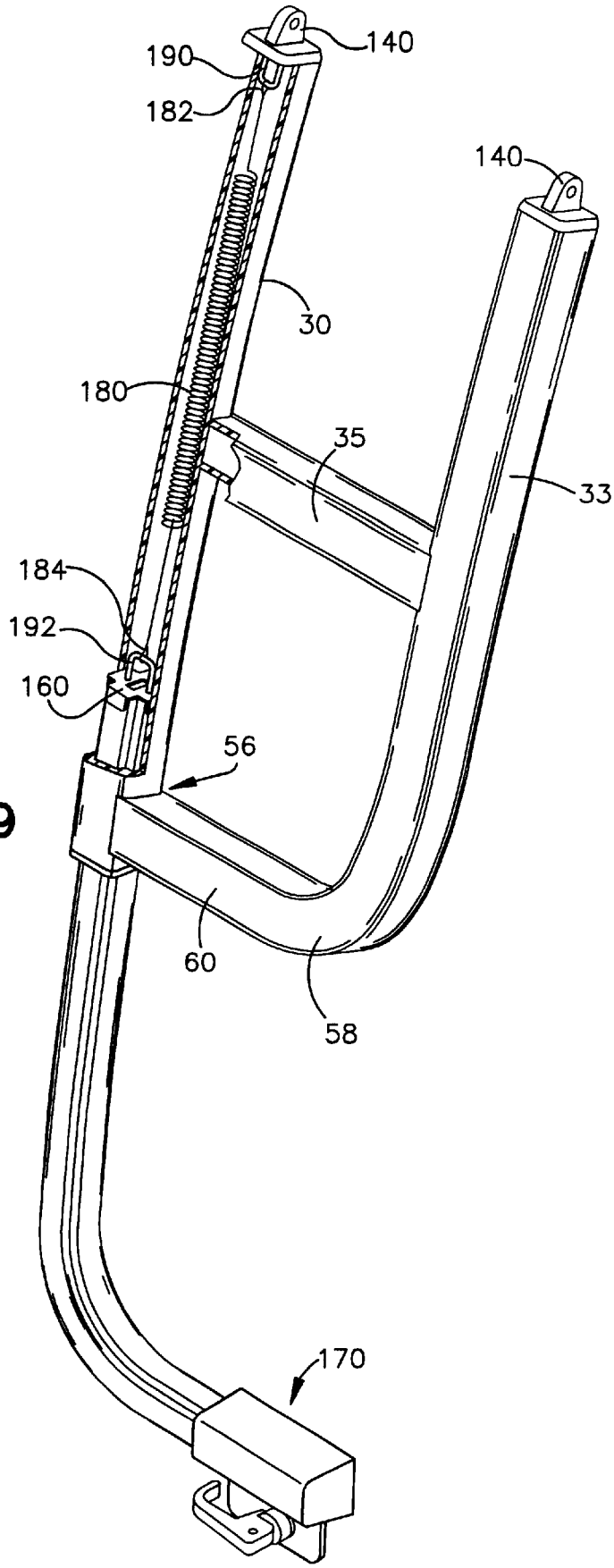
FIG. 9 is a perspective view, partially in section, of the bunk ladder of FIG. 1 in an installed position, showing a spring within a portion of the ladder.

The preferred embodiment of the ladder includes an advantageous feature that permits ease of transition for an operator when collapsing the ladder from an application position to a storage position. Referring now to FIG. 9, a perspective view, partially in section, is shown of the bunk ladder in an installed position. As shown, the first side rail 30 is hollow and contains a spring 180. The spring 180 includes a first end 182 and a second end 184. The first end 182 is fixed to the first side rail mounting end. As shown, the first end 182 is fixed to an eyelet 190. The eyelet 190 extends downwardly from the mounting cap 140. The second end 184 is fixed to the lower member first end. As shown, the second end 184 is fixed to an eyelet 192. The eyelet 192 extends upwardly from the inner bearing cap 140.

Referring again to FIG. 9, the spring 180 is shown in an extended position. When an operator does not have an immediate need for the ladder, or desires more room in the sleeping berth, the ladder can be easily placed in a stored position. When the latch is rotated and disengaged from the lower bed frame, the spring 180 recoils and acts to aid in the collapsing of the ladder. A spring of any suitable design having any suitable spring constant made be used in the practice of this invention. The spring constant should preferably be large enough to aid in collapsing, but not large enough to unduly burden the operator when transitioning the ladder from a stored position to an application position.

The preferred embodiments of the invention have been illustrated and are described in detail. However, the present invention is not to be considered limited to the precise construction disclosed. Various adaptations, modifications and uses of the invention may occur to those skilled in the art to which the invention relates and the intention is to cover hereby all such adaptations, modifications and uses which fall within the spirit or scope of the appended claims.

What is claimed is:

1. A ladder apparatus for installation in an environment to aid access to an elevated area within the environment, the apparatus comprising:

a) an upper member comprising:

i. an elongated first side rail comprising a mounting end, an open end, and a center portion extending between said mounting end and said open end, wherein at least the part of said center portion disposed adjacent said open end is hollow, said mounting end having structure for rotateably mounting said first side rail to a first mating surface, and said open end defining an aperture;

ii. an elongated second side rail comprising a first end, a second end, and a center portion extending between said first end and said second end, said first end having structure for rotateably mounting said second rail to a second mating surface; and iii. at least one step rung rigidly disposed between said first and second side rails; and b) a lower member comprising a first end, a second end, and a center portion extending between said first and second end, wherein said lower member first end is slideably engaged within said upper member open end to define a ladder length, said second end having structure for removably mounting said lower member to a third mating surface when said ladder is in use and to a fourth mating surface when said ladder is in storage;

c) wherein said structure of said lower member second end comprises a latch mechanism, said latch adapted to alternatively be removably fixed to said third mating surface or to said fourth mating surface;

d) wherein said length of said ladder is adjustable over a range by sliding said lower member with respect to said upper member.

2. The apparatus of claim 1 wherein said second side rail comprises a portion essentially parallel to said at least one step rung, wherein said portion forms a second step rung.

3. The apparatus of claim 1 wherein said second side rail second end terminates at said first side rail.

4. The apparatus of claim 1 wherein said upper member is constructed of extruded plastic.

5. The apparatus of claim 1 wherein said lower member is constructed of extruded plastic.

6. The apparatus of claim 1 wherein said lower member center portion comprises an arcuate portion.

7. The apparatus of claim 1 wherein said second side rail center portion comprises an arcuate portion.

8. The apparatus of claim 1 wherein said aperture and said lower member first end are adapted to essentially prohibit rotational movement of said lower member with respect to said upper member.

9. The apparatus of claim 1 further comprising a spring disposed within said elongated first side rail, said spring connected between said first side rail mounting end and said lower member first end, such that said spring is extended when said apparatus is in use, and recoils when said apparatus is in storage.

10. In an over-the-highway tractor having a sleeping berth containing a bunk system, said system including a back wall, an upper bunk frame, a lower bunk frame, and a ladder for aiding operator access to the upper bunk, the improved ladder comprising:

a) an upper member comprising:

i. an elongated first side rail comprising a mounting end, an open end, and a center portion extending between said mounting end and said open end, wherein at least the part of said center portion disposed adjacent said open end is hollow, said mounting end having structure for rotateably mounting said first side rail to a first mating surface defined by the upper bunk frame, and said open end defining an aperture;

ii. an elongated second side rail comprising a first end, a second end, and a center portion extending between said first end and said second end, said first end having structure for rotateably mounting said second rail to a second mating surface defined by the upper bunk frame; and iii. at least one step rung rigidly disposed between said first and second side rails; and b) a lower member comprising a first end, a second end, and a center portion extending between said first and second end, wherein said lower member first end is slideably engaged within said upper member open end to define a ladder length, said second end having structure for removably mounting said lower member to a third mating surface when said ladder is in use and to a fourth mating surface when said ladder is in storage, c) wherein said third mating surface is defined by the lower bunk frame and said fourth mating surface is defined by the upper bunk frame;

d) wherein said length of said ladder is adjustable over a range by sliding said lower member with respect to said upper member, wherein said range is at least from a storage length to an application length.

11. The apparatus of claim 10 wherein said structure of said lower member second end comprises a latch mechanism, said latch adapted to alternatively be removably fixed to said third mating surface or to said fourth mating surface.

12. The apparatus of claim 12 wherein said second side rail comprises a portion essentially parallel to said at least one step rung, wherein said portion forms a second step rung.

13. The apparatus of claim 10 wherein said second side rail second end terminates at said first side rail.

14. The apparatus of claim 10 wherein said upper member and said lower member are constructed of extruded plastic.

15. The apparatus of claim 10 wherein said lower member center portion comprises an arcuate portion.

16. The apparatus of claim 10 wherein said second side rail center portion comprises an arcuate portion.

17. The apparatus of claim 10 wherein said aperture and said lower member first end are adapted to essentially prohibit rotational movement of said lower member with respect to said upper member.

18. The apparatus of claim 10 wherein said application length is essentially equal to the distance from an outermost point of the upper bunk frame to an outermost point of the lower bunk frame, each outermost point with respect to the back wall.

19. The apparatus of claim 10 wherein said storage length does not exceed a length of the upper bunk frame, wherein said ladder nests when mounted in a stored position adjacent an underside of the upper bunk frame.

20. The apparatus of claim 10 further comprising a spring disposed within said elongated first side rail, said spring connected between said first side rail mounting end and said lower member first end, such that said spring is extended when said apparatus is mounted in an application configuration, and recoils when said apparatus is moved to a storage configuration.

* * * * *